United States Patent [19]

Williams

[11] Patent Number: 5,018,674

[45] Date of Patent: May 28, 1991

[54] GRATE ASSEMBLY IN A DOWN DRAFT IMPACT MILL

[76] Inventor: Robert M. Williams, 16 La Hacienda, Ladue, Mo. 63124

[21] Appl. No.: 555,798

[22] Filed: Jul. 20, 1990

Related U.S. Application Data

[63] Continuation of Ser. No. 419,256, Oct. 10, 1989, abandoned.

[51] Int. Cl.[5] ..... B02C 13/284

[52] U.S. Cl. ..... 241/88.4; 241/74; 241/189 R

[58] Field of Search ..... 241/73, 88.4, 189 R

[56] References Cited

U.S. PATENT DOCUMENTS 1,751,009 3/1930 Liggett ..... 241/88.4 X
3,480,214 11/1969 Wageneder ..... 241/73 X
3,891,152 6/1975 Guggenheimer ..... 241/88.4
4,637,557 1/1987 Vitunac ..... 241/73
4,706,899 11/1987 Schonfeld et al. ..... 241/73

*Primary Examiner*—Timothy V. Eley
*Attorney, Agent, or Firm*—Gravely, Lieder & Woodruff

[57] ABSTRACT

A rotary hammer grinding mill having the rotary hammer rotor exposed in a housing between a material inlet and a ground material outlet in which the grate assembly on the outlet side of the rotor is composed of a series of spaced cradle ribs curving around the outlet side of the rotor and supporting a series of spaced bars directed transversely to the cradle ribs. The cradle ribs and bar spacing defines a series of openings having short passages offering greatly reduced resistance to the flow of ground material so there is substantially established a down-draft operation of the mill without the need to connect up a suction fan to the mill outlet.

1 Claim, 1 Drawing Sheet

FIG. 4.
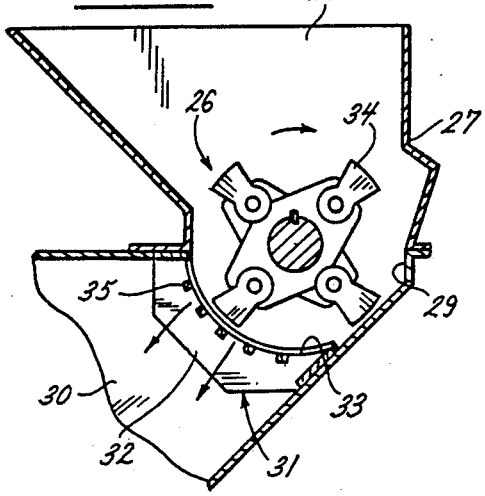
FIG. 2.
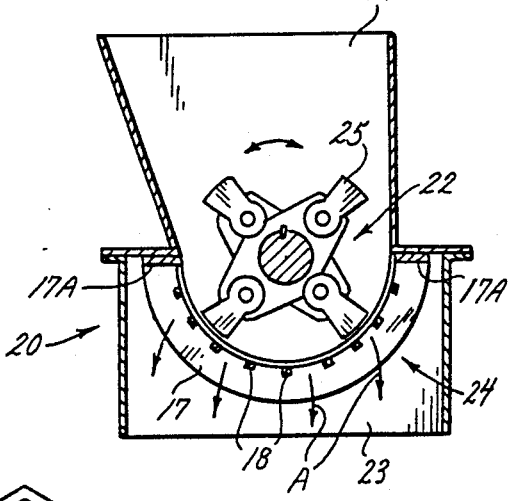
FIG. 1.
PRIOR ART
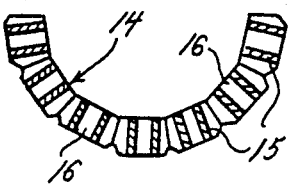
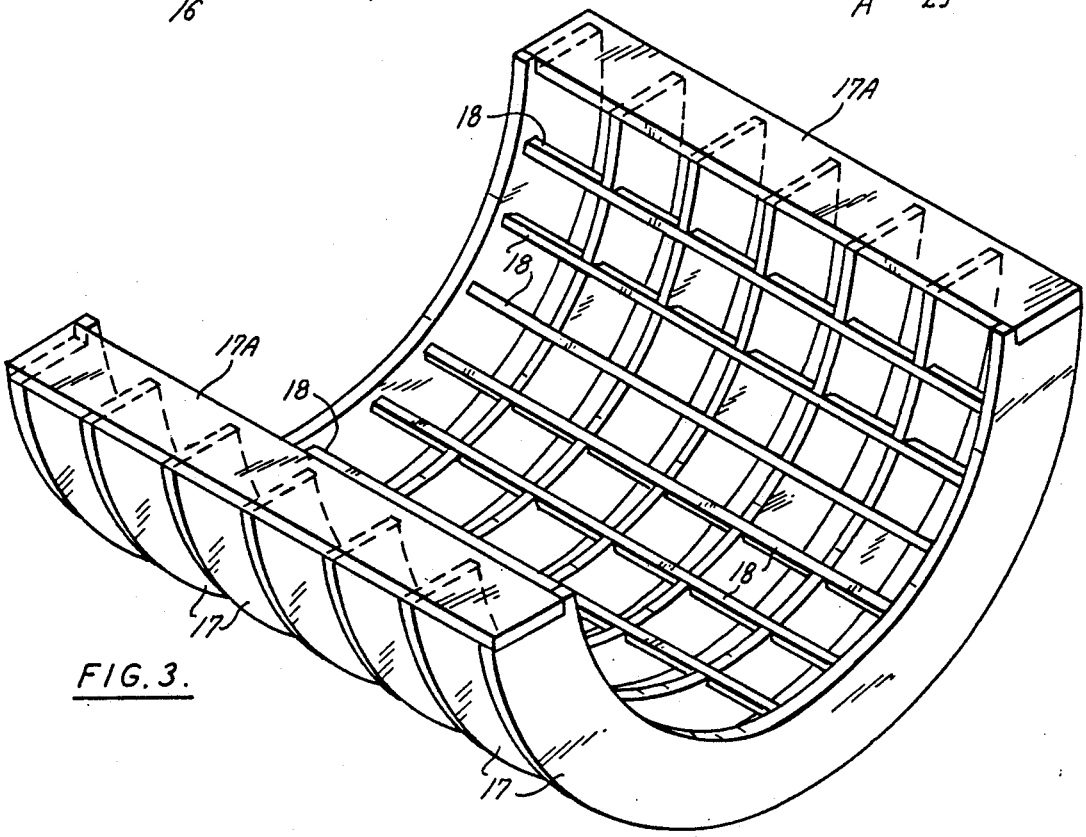
FIG. 3.

GRATE ASSEMBLY IN A DOWN DRAFT IMPACT MILL

This is a continuation of copending application Ser. No. 07/419,256 filed on Oct. 10, 1989, now abandoned.

BACKGROUND OF THE INVENTION

1. Field of the Invention

This invention is directed to an improved cage assembly for impact mills to obtain the fan effect of the mill rotor in assuring down draft operation.

2. Description of the Prior Art

The normal construction by almost all manufacturers of impact shredders or hammer mills has provided a type of cage design in which the cage is made up of a grate consisting of a series of separate ribs supported at the opposite ends. Examples are seen in 3,610,543 of Oct. 5, 1971, 3,806,048 of April 23, 1974 or 4,009,836 of Mar. 1, 1977. The ribs usually present a series of spaces having a dimension about equal to the thickness of the grate to make up a strong, rigid and substantially unbending cage over the outlet of the mill. The spaces or openings in the grate are aligned to be oriented along radii from the axis of the hammer rotor.

It was heretofore believed that the cage had to be rigid and that the outlet through the grate should be divided into narrow passages in order to size the particles that could pass through. The result of that typical grate structure was that the high differential pressure across the grate, and the resistance to the flow of air created a back flow toward the incoming supply of material due to the lift of the rotating hammers, and any light weight materials, like paper, plastic scraps, were blown up through the inlet to create a mess around the inlet to the mill. When the reverse flow which created the mess was not desired, a suction fan connected to the mill outlet had to be used.

BRIEF SUMMARY OF THE INVENTION

A principal object of the present invention is to construct the grate for an impact mill with a series of spaced cradle ribs interconnected by bars of small cross-section attached to the ribs in spaced apart positions adjacent the path of the rotating impact hammers, thereby forming openings in the grate that offers reduced resistance to the flow of air and ground material, thereby creating a down draft action at the mill outlet.

A further object of the present invention is to arrange cradle ribs in the grate which are aligned across the mill outlet so as to be perpendicular to the axis of the rotor, and set so the flat sides of the ribs are parallel to the path the ground material wants to take, and to direct bars of small size cross-section in horizontal positions crosswise of the ribs to form small openings so the ground material, when sized to penetrate the grate, encounters very little resistance from the grate, and is relatively freely propelled by the fan action of the rotor hammers to increase the mill capacity.

Still another object of the present invention is to have the mill housing formed with a material inlet that exposes the rotor over substantially its full diameter of hammer travel and to form a grate with a system of cradle ribs and transverse bars that form a pattern of openings to determine the particle size of the ground material and to reduce the dimension of the bars so the effective thickness of the grate is equal to the radial dimension of the ribs.

BRIEF DESCRIPTION OF THE DRAWINGS

The subject matter of the present invention is seen in its presently preferred form in the following views, wherein:

FIG. 1 is a fragmentary grate assembly representing an example of the prior art;

FIG. 2 is a fragmentary vertical section of another example of an impact mill having an outlet grate extending over a full diameter of the rotor hammer circle;

FIG. 3 is a perspective view of the grate assembly for a mill seen in FIG. 2.; and FIG. 4 is a fragmentary vertical section of a side discharge impact mill in which the grate assembly is made in accordance with the principals of this invention.

DETAILED DESCRIPTION OF THE EMBODIMENTS

Looking at FIG. 1, there is shown a typical example of a common grate assembly seen in 3,806,048 in which the grate consists of bars 14 which form the mill outlet. Each bar 14 is formed as a longitudinal beam 15 held in parallel and spaced relationship by a series of spaced webs 16 which extend crosswise of the beams and have appreciable radial dimensions equal to the radial dimension of the beams 15. Since a grate of this character offers considerable resistance to the passage of air and ground material, and because the pressure drop across the grate is high, the flow is reflected back toward the rotor hammer with sufficient force to blow the light weight material out through the inlet.

The so-called blow back problem can be overcome when the mill is carefully designed to make use of the fan effect of the impact hammers during rotation, after some experiments it has been determined that the blow back problem can be overcome by redesigning the mill grate so that the pressure drop across the grate is decreased and the resistance to air flow is reduced.

It is seen in FIGS. 2 and 3 that the grate has curved cradle ribs 17 and respective bars 18 that have a small cross sectional dimension which reduces the resistance the bars 18 offer to the flow of air and airborne ground material. Since the cradle ribs 17 are the primary load carrying members they can vary in dimension, as measured radially of the rotor axis, of from four inches to up to about six inches. The thickness of each cradle rib 17 is determined by the plate material from which it is made, such as one-half inch plate stock. The bars 18 can be selected from square bar stock which may be about three-eighths inch square.

FIG. 2 is directed to an impact mill 20 having a housing inlet 21 that opens into the hammer rotor 22 so it can be effective to grind material for either direction of rotation. The housing outlet 23 for ground material receives a grate assembly 24 extending over substantially 180° of the circular path for the hammers 25. The grate assembly 24 shown in FIG. 3 is composed of a series of spaced primary cradle ribs 17 which have curved edges presented to the tip circle followed by the hammers 25. These cradle ribs 17 are stabilized by top plates 17A and by a series of transversely directed bars 18. The location of the bars 18 seated in notches in the curved edges of the cradle ribs 17, allows a (see arrows A) substantially low resistance to the flow of ground material and air which encourages a high pressure drop across the position of the bars 18 at the curved edges of the cradle ribs 17. The creation of a low pressure drop prevents the development of a blow back through the inlet 21 because there is a substantial absence of resistance at the curved face of the grate formed by the crossing arrangement of edges of the cradle ribs 17 and bars 18. The cradle ribs 17 in one embodiment of the invention seen in FIG. 3 are separated at about two inch spacings, and the bars 18 are spaced apart so that the openings defined by the bars and cradle ribs are about two inch square to determine the size of the ground material passing the grate. The passage of the airborne ground material through the grate openings is indicated by arrows A.

Another example of a down draft mill is seen in FIG. 4 where the hammer rotor 26 is mounted in a housing 27 having a material inlet 28 for directing the material onto the rotor 26 so it is thrown against a brakerplate wall 29. The mill outlet 30 is of a type to direct the ground material laterally for convenience of handling. The sizing of the ground material is accomplished by a grate 31 composed of a series of cradle ribs 32 having a sufficient radial dimension to withstand the impact of material during the grinding. The cradle ribs 32 may be spaced apart to gauge particle size with a sufficient number to fit into the mill outlet passage. The cradle ribs 32 are formed with a curved edge 33 which is shaped to match the curved path of the hammer tips 34. The series of cradle ribs 32 are structurally stabilized and united into a grate assembly by a series of bars 35 secured by welding into notches formed in the curved edge 33 of the cradle ribs 32. The spacing of the bars 35 will work with the spacing of the cradle ribs 32 to form a grid of openings which will determine particle size of the material eventually ground by the hammer rotor 26.

In view of the foregoing specification, it can be appreciated that the invention is directed to rotary impact grinding mills having the usual housing providing an inlet for material to be ground, an outlet for the ground material, a rotor having hammers moving in a circular path between the inlet and the outlet with the path of hammer rotation substantially open up to about 180° of the path of rotation of the rotor, and in which an improvement consists in a grate assembly that does not impose a resistance to the delivery of ground material and air as developed by the roter, whereby the blow back into the inlet of light weight material such as paper and plastic is substantially suppressed. Furthermore, the improvement is characterized by a series of spaced cradle ribs which are positioned to be substantially perpendicular to the axis of rotation of the grinding rotor, and a second series of spaced bars secured in transverse positions by suitable notches in the curved edges of the cradle ribs presented to the hammer path of rotation. The assembly of the cradle ribs and transverse bars forms a grid of openings that define the size of the ground particles allowed to flow through the outlet. In view of the limited size of the bars, the fan effect of the rotor hammers drives the material through the grid of grate openings as those openings impose a very low or negligible resistance. In prior grate constructions the components usually presented considerable surface areas in the depth wise radial direction which resisted flow to the exterior. The resistance has allowed the hammers to lift the material back to the inlet side. Such back flow erupts to the outside of the housing and reduces the throughput of the mill to a significant extent when compared with the present mill having the improved grate assembly.

What is claimed is:

1. In a rotary impact grinding mill having a housing formed with an inlet for material to be ground, a shaft mounted material grinding rotor carrying hammers operably mounted thereon to move in a circular path to intercept incoming material to be ground, and an outlet of the ground material, the improvement comprising a grate assembly mounted in the housing outlet to form a grid of grate openings defining a curved face presented to the hammers and including:

(a) a series of side-by-side ribs arranged in spaced apart positions, said ribs having edges and flat sides, the dimension of said flat sides determining the thickness of the grate assembly and the flat sides forming passages having low resistance to the flow of air and ground material, said ribs edges being curved to conform to the path of the material grinding rotor hammers for grinding material;

(b) stabilizing bars engaged with said series of side-by-side ribs to stabilize said ribs in said spaced apart positions, said bars being positioned in the curved face of the grid and having a dimension less than the thickness of said grate assembly and cooperative with said ribs in forming the size of openings for the passages of ground material; and (c) said side-by-side ribs being directed substantially perpendicular to said stabilizing bars, and said stabilizing bars being parallel to said rotor shaft.

* * * * *